US005686884A

United States Patent [19]

Larkin et al.

[11] Patent Number: 5,686,884

[45] Date of Patent: Nov. 11, 1997

[54] SUPERVISED ALARM SYSTEM

[76] Inventors: Dennis S. Larkin, 1937 The Woods Cir., Barnhart, Mo. 63012; William J. Aaron, Jr., 7562 Genesta, St. Louis, Mo. 63123; Charles W. Kertz, 2058 Woods Cir., Barnhart, Mo. 63012

[21] Appl. No.: 582,588

[22] Filed: Jan. 3, 1996

[51] Int. Cl.[6] ..... G08B 29/00

[52] U.S. Cl. ..... 340/506; 340/407.1; 340/573; 340/825.19; 601/60; 5/108; 5/109

[58] Field of Search ..... 5/108, 109, 915; 601/60; 340/407.1, 815.69, 333, 825.19, 506, 573; 318/544

[56] References Cited

U.S. PATENT DOCUMENTS

| | | | |
|---|---|---|---|
| 804,653 | 1/1905 | Garris . | |
| 2,460,133 | 1/1949 | Pedus | 161/22 |
| 2,561,481 | 7/1951 | Rody | 161/22 |
| 2,580,598 | 1/1952 | Rody | 161/22 |
| 3,786,628 | 1/1974 | Fossard et al. | 58/152 B |
| 4,028,882 | 6/1977 | Muncheryan | 58/152 B |
| 4,093,944 | 6/1978 | Muncheryan | 340/279 |
| 4,553,138 | 11/1985 | Nakanishi et al. | 340/584 |
| 4,793,010 | 12/1988 | Gross et al. | 5/109 |
| 4,951,331 | 8/1990 | Pereira | 5/109 |
| 5,003,651 | 4/1991 | Rosen | 5/109 |
| 5,144,600 | 9/1992 | Cheng | 368/12 |
| 5,348,370 | 9/1994 | Fukuoka | 297/217 |

*Primary Examiner*—Jeffery Hofsass
*Assistant Examiner*—Daryl C. Pope
*Attorney, Agent, or Firm*—Herzog, Crebs & McGhee

[57] ABSTRACT

A power supervised emergency warning device provides a shaking motion to a piece of furniture coupled thereto upon receipt of an electronic actuating signal from an external closed contact type device. A backup battery provides power to the device in the case of a main power outage. External warning devices may be coupled to the device which are activated upon receipt by the device of the actuating signal. Additional external device hook-ups are provided as well as the ability to be coupled to auxiliary modules. The auxiliary modules accept actuating signals from additional external closed contact type devices to produce shaking. Additional indication devices may also be coupled thereto. Additional auxiliary modules may also be chained thereto.

10 Claims, 4 Drawing Sheets

AUXILIARY I/O CIRCUIT

SUPERVISED ALARM SYSTEM

BACKGROUND OF THE INVENTION

1. Field of the Invention

The present invention generally relates to warning systems or devices and, more particularly, to devices for notifying a person during an alarm condition.

2. Prior Art

Throughout the years, there have been developed various warning systems and devices such as, burglar alarms, smoke and gas detectors, fire alarms and the like, that produce an audible warning signal such as a buzzer, bell, siren or horn in order to warn or notify individuals of an emergency situation. These devices are generally of the stand-alone type or are a system dedicated to monitoring a particular type of event.

It has long been recognized through that such conventional warning or emergency notification systems or devices cannot effectively warn or notify individuals who are disabled to one degree or another by a hearing impairment. Even alarm systems that produce a visual signal also may not be effective for people with impaired or no sight.

In view of this, prior art warning devices have been devised that have alternative warning indicators such as some sort of vibration means to provide a tactile alarm. Generally, these alarm devices are attached to a pillow or bed wherein an actuating device can trigger the vibration means. For example, U.S. Pat. No. 4,553,138, Nakanishi et al., entitled FIRE ALARM SYSTEM, issued Nov. 12, 1985, teaches a warning device which produces an audible alarm as well as a tactile alarm. The warning device is coupled to a bed and is actuated by a fire sensing device (e.g. smoke detector) that activates the device's alarm. Similarly, U.S. Pat. No. 3,786,628, Fossard et al., entitled WARNING SYSTEM AND METHOD, issued Jan. 22, 1974, teaches a warning device that utilizes a mechanical vibration generator and is triggered by a signal from a source such as an alarm clock, a doorbell, or a car horn. Other such examples of warning device are U.S. Pat. No. 2,561,481, Rody, issued Jul. 24, 1951 and U.S. Pat. No. 2,580,598, Rody, issued Jan. 1, 1952.

While these prior art devices are somewhat satisfactory in operation, they all suffer from inherent limitations or shortcomings such as interruption of use during loss of power, proximity to the effected persons, and other general inadequacies. In short, the prior art devices are not adaptable for use with a variety of input or output devices, but are tied to specific actuation and indication devices. Further, the prior art devices do not permit flexible configuration as needed for the specific disability of the person or people being warned.

In view of the above, it is an object of the present invention to provide a reliable way of notifying a sleeping person, deaf person, blind person, or hearing impaired person of a fire or life threatening emergency situation.

It is another object of the present invention to provide an alerting device that can function either as a stand-alone alarm or within an alarm system, and which therefore may become a general or specialized alarm unit.

It is further an object of the present invention to provide a warning device that will operate with or without utility company power.

It is yet another object of the present invention to provide an alarm device that accepts auxiliary input devices for triggering the alarm device such as smoke detectors, gas detectors, sprinkler alarms, and provide a means of electrical supervision of the auxiliary input devices.

It is further another object of the present invention to provide a warning device which provides supervision circuits for all input and output devices wired to the unit and provide for an audible internal alarm should there be a wiring deficiency or fault.

It is still another object of the present invention to provide a warning device that can be adapted to receive an activating signal from a plurality of external devices and that can activate a plurality of external alarm indication devices.

SUMMARY OF THE INVENTION

The present invention is an alarm condition alerting device that is coupled to and actuated by an existing external alarm device. The present alerting device provides a tactile indicator that is attachable to a piece of furniture and that can trigger other external devices coupled thereto in order to provide a plurality of alarm indicators if the need arises. A dual power system is provided as well as the provision of hookup to a plurality of auxiliary indicator/trigger modules.

In one form thereof, the present invention is a furniture shaking device that will provide a shaking motion to a piece of furniture when an alarm condition is present as indicated and triggered by an external alarm device in order to wake or notify the individual in or on the piece of furniture. The present invention includes an electromechanical reciprocating structure attachable to a piece of furniture that is operably regulated by a control circuit. The control circuit is actuated by means of any external closed contact type electrical external alarm device wired thereto such as a smoke detector, burglar alarm, or the like. The shaking device is designed to operate on transformed and rectified 120 volt power but includes a backup battery and system to supply power for activation of the shaking device during a main power outage. Automatic switching circuitry is provided allowing the shaking device to switch from the 120 volt power source to battery power and back to the 120 volt power source when the 120 volt power source is eventually restored, thereby assuring operation of the shaking device at all times.

The control circuit includes a supervision circuit to monitor the incoming 120 volt power source and the battery, and provides an alarm signal should there be an interruption or fault with the power sources. Additionally, the shaking device includes a battery charging circuit to trickle-charge the battery when power is being utilized from the 120 volt power source. A test button is also included in the control circuit to test and verify circuit operativeness, as well as short circuit safety protection.

The shaking device includes input terminals adapted to receive activating signals from various open or closed contact type input devices and includes several output terminals for the coupling of external alarm indication devices. A power terminal is also supplied for providing a means of power for the external devices, if needed.

In accordance with one aspect of the present invention, the shaking device includes an auxiliary module input for connection of an auxiliary module thereto. The auxiliary module includes an external activation input terminal for receipt by the auxiliary module of an activation signal from a separate external alarm device, and an output terminal for connecting and activating an external signal device. Additionally, the auxiliary module activates the electromechanical reciprocating structure to provide the shaking motion to the piece of furniture attached thereto.

In an embodiment thereof, the present warning device includes a housing having therein a DC motor with an associated rotatable shaft. The shaft extends through the housing and is coupled to a disc so as to rotate the disc upon rotation of the shaft. A rigid arm is coupled to the disc such that rotation of the disc imparts a reciprocating motion to the arm. The arm is thus attached to the piece of furniture. A control circuit is also disposed within the housing and is operable to turn on the motor upon receipt of an actuating signal. The control circuit operates on DC voltage normally supplied by a regular 120 volt power source that has been stepped down and rectified. A gel-cell type rechargeable battery is located within the housing and is electrically coupled to the control circuit to provide DC power thereto during an outage of the 120 volt power source. A battery charging circuit may be included to trickle charge the battery.

The control circuit includes normally open input terminals for connection of an external activating or alarm signal device thereto such as a smoke detector, burglar alarm, carbon monoxide detector, or the like, that has output terminals which provide a closed contact electrical (actuating) signal. A supervision circuit is also provided to monitor and indicate a failure of the 120 volt power source and the battery. The supervision circuit provides a signal to two sets of trouble output terminals, a normally closed type and a normally open type. In addition to indicators in the housing which are electrically coupled to the control circuit, an external trouble warning or indicating device, such as a light or buzzer, may be coupled to the trouble output terminals to indicate such a power failure condition. The external trouble device can be separately powered or powered by the internal power supply and is coupled to the corresponding trouble output terminal type depending on which type of signal it needs to trigger itself.

In addition to the above, the control circuit includes a current regulated DC output and external alarm indication outputs for powering and coupling a separate external alarm indicating device, again such as a light producer, a sound producer or the like, to signal or wake up the person in addition to the shaking motion.

Integral to the control circuit is an auxiliary module coupling for connecting an auxiliary module circuit board and associated circuitry. The auxiliary module includes external warning device inputs that will trigger the motor to provide the shaking motion, upon receipt of an actuating signal from the external warning device. The auxiliary module also includes signal output terminals to send an appropriate signal to powered, external warning device, such as lights, sound producers and the like. An auxiliary board coupling is further provided to "chain" auxiliary circuit boards.

In operation (without an auxiliary module coupled thereto), the present warning device is activated by means of an activating signal from the external closed contact device. Upon receiving the actuating signal, the motor and arm assembly is started, thereby shaking or vibrating the piece of furniture attached to the arm. Additionally, externally connected devices would also be activated to provide other warnings such as lights, buzzers or horns. In the case of a main power failure, the autoswitching circuit automatically allows the control circuit to draw power from the on-board backup battery. Once main power is restored, the autoswitching circuit switches out the battery to allow the main power to supply the required energy to the control circuit. During main power usage, a trickle-charging circuit recharges the battery. Supervision of the power sources is constant. The auxiliary module functions in the same manner.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiment thereof which is illustrated in the appended drawings.

It is noted, however, that the appended drawings illustrate only a typical embodiment of this invention and is therefore not to be considered limiting of its scope, for the invention may admit to other equally effective embodiments.

DESCRIPTION OF THE PREFERRED EMBODIMENT

Figure 1:
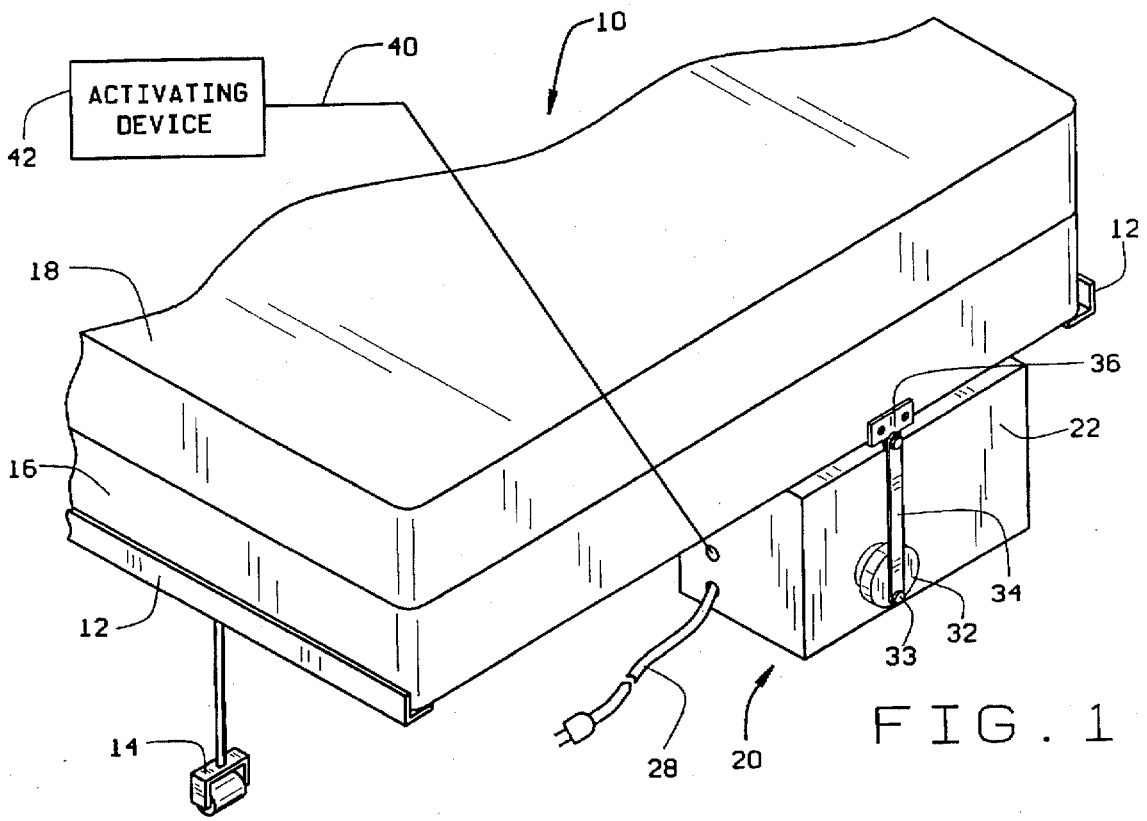
FIG. 1 is a partial perspective view of a bed with the present warning device attached thereto.

Referring now to FIG. 1 there is shown a typical bed generally designated 10 that includes a frame 12 with rollers 14 attached thereto for moving the bed 10. As is typical, the bed frame 12 has a box spring 16 and mattress 18 situated thereon. Shown coupled to the box springs 16 is the present shaking warning unit or device generally designated 20. It should here be understood that the present device 20 is not limited to hook up with a bed, but rather is adaptable to be attached to any piece of furniture or otherwise in which the shaking motion is desired. It is also possible to not hook up the tactile alarm and use the other functions as described below. Regardless, reference will be made to a bed as the primary piece of furniture.

Figure 2:
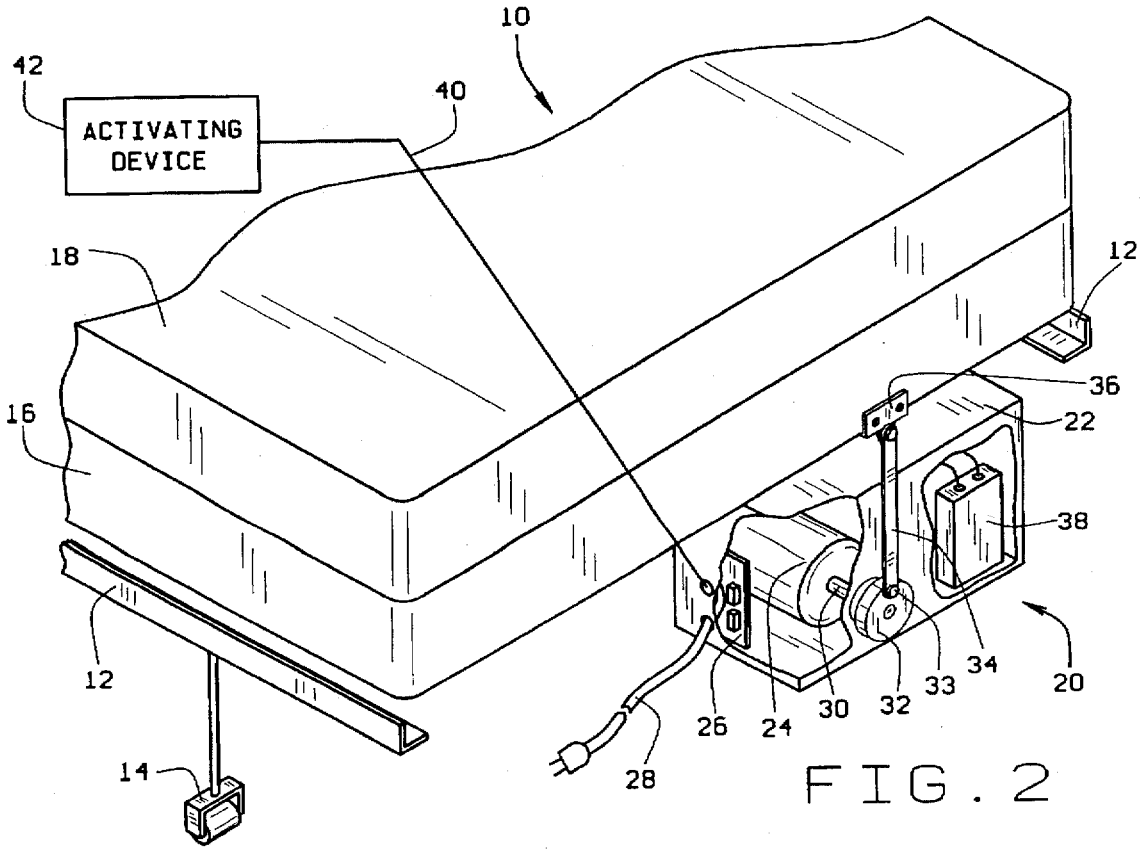
FIG. 2 is a partial perspective view of the bed of FIG. 1 with the device in partial cut-away showing the backup battery, control circuit board, and motor attached to an arm, the bed shown in the upward position.

The device 20 includes housing 22 preferably made of a sturdy material such as metal, that is placed proximate to the bed 10. Referring additionally to FIG. 2, the housing 22 encloses a motor 24 that is electrically coupled to a control circuit board 26. The control circuit board 26 is electrically coupled via cord 28 to a main 120 volt AC electrical source (not shown) such as a typical household outlet. The motor 24 naturally includes a rotatable motor shaft 30 that extends external to the housing 22 and terminates with a disc 32 attached thereon. The disc 32 may or may not be a cam or eccentric depending on the attachment location of the rigid arm 34 to the disc 32. In FIG. 2, the arm 34 is attached near the periphery of the disc 32 at 33 to create a reciprocating motion in the arm 34 as the disc 34 rotates. Attached at the end opposite attachment point 32 is an attachment bracket 36 here connected to the box springs 16.

As described below, the control board 26 controls the actuation of the motor 24 and thus the movement of the bed 10. A 12 volt backup battery 38, device of the "gel-cell" type, is also disposed within the housing 22 and is electrically coupled to the control board 26. Electrically coupled to the control board 26 via wire 40 is an external actuating or activating device 42. The device 42 may be a smoke detector, burglar alarm, carbon monoxide detector, or the like, that provides a closed contact type output signal. The control circuit could, of course, be modified to accept an activation input from an open contact type signal by one skilled in the art. The output signal of the external device is the actuating signal for the control board 26.

Figure 5:
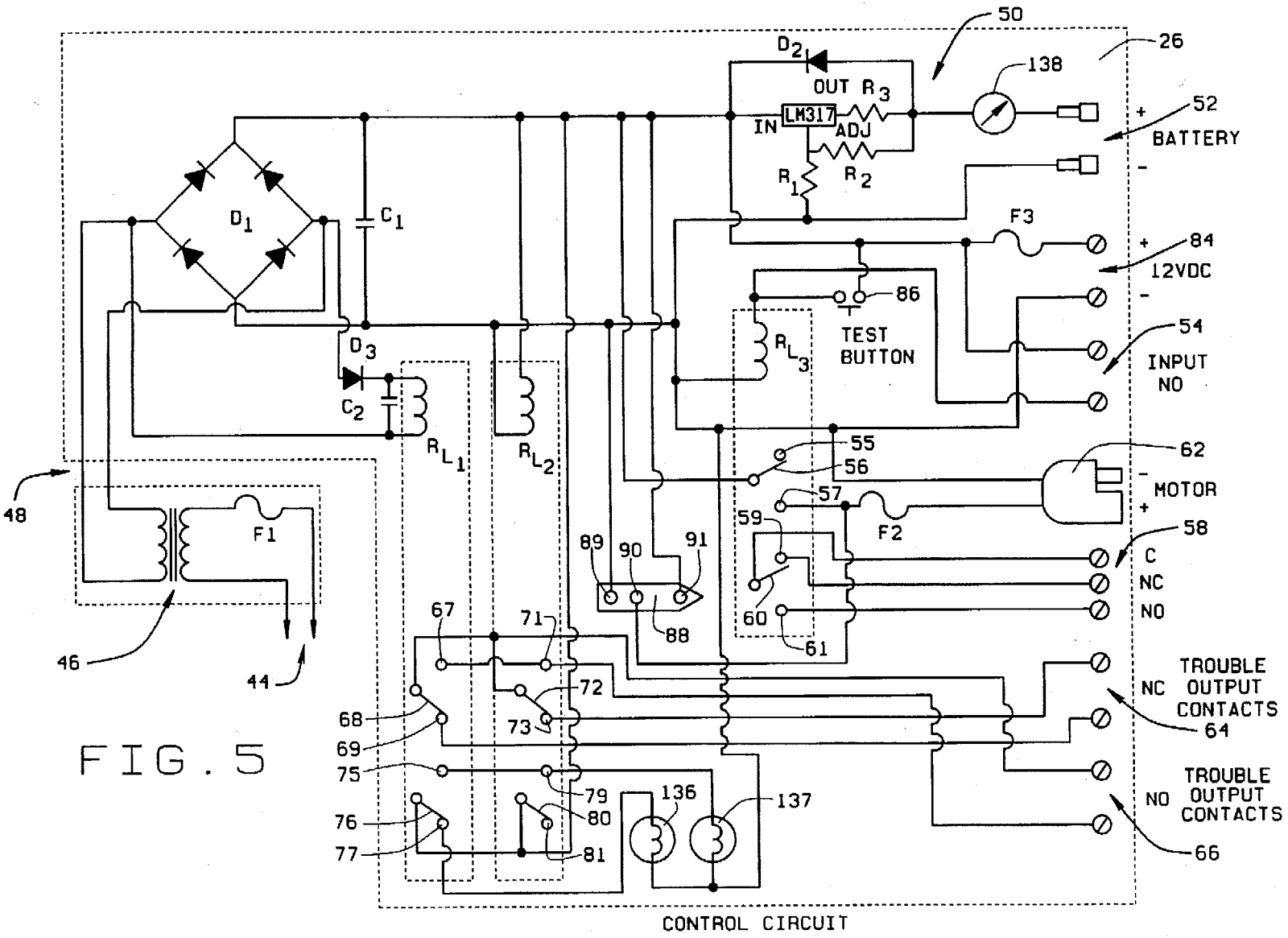
FIG. 5 is an electrical schematic of the control circuit.

Referring to FIG. 5, the electrical schematic for the control circuit 26 is depicted. The control circuit 26 obtains operating power through connection at 44 to a typical household 120 volt AC outlet (not shown). The 120 volt AC power is fed through a 10 Amp. fuse F1 and into a step-down transformer 46. The output 48 of the transformer 46 is 12.6 VAC. The transformer 46 and fuse F1 are shown as devices external to the control circuit 26 but could be on-board as well. The transformer output 48 is fed into a typical full-wave rectifier circuit D1 such that the output of D1 as seen by smoothing capacitor C1, a 35 VDC 4700 μF capacitor, is 12.6 VDC.

Electrically coupled to the output of the rectifier D1, is a combination trickle-charging and autoswitching circuit 50 that consists of a transistor, LM317, associated resistors, R1, R2, and R3, a blocking diode D2, and a charging meter 138, the charging meter 138 provides a visual indication of the state of charge of the battery 38. Coupled to the circuit 50 are battery terminals or contacts 52 to which is connected the battery 38. The circuit 50 trickle-charges the battery 38 when power for the control circuit 26 is being supplied by the 120 volt AC power source. Additionally, the circuit 50 automatically switches battery power to the control circuit 26 when the 120 volt AC power source is non-functional, and switches out the battery 38 when the 120 volt AC power is functional, at which time recharging of the battery 38 takes place. The control circuit 26 has a normally open input 54 to which is coupled the external activating device 42. Because the input 54 is normally open, the activating device 42 must provide a closed contact signal thereto. The input 54 thus receives the activating or actuating signal to trigger the control 26 to start the motor 24 to shake the bed 10. This is accomplish through relay $R_{L3}$ and one of its associated switches 56. In the normal operating mode or state of the control circuit 26, the switch 56 is in an "up" position against post 55 as depicted in FIG. 5 such that fuse F2 is open circuited, and thus no power reaches the motor 24 through motor coupling 62. Upon receipt of the actuating signal through input 54, the relay $R_{L3}$ is energized, thereby moving switch 56 to a "down" position in contact with post 57 thereby allowing energy to flow to the motor 24. The relay $R_{L3}$ is energized until the actuating signal ceases so that the bed 10 is shaken until that time.

The control circuit 26 also has a supervisory circuit and associated trouble output contacts 64 and 66. The supervisory circuit essentially consists of a first relay $R_{L1}$ and a second relay $R_{L2}$. Relay $R_{L1}$ and associated capacitor C2 and diode D3 is coupled to the transformer 46 on either input sides of the rectifier D1. The relay $R_{L1}$ indicates a main (100) 120 volt AC power failure. Relay $R_{L1}$ has two switch arms 68 and 76. Switch arm 68 is associated with the trouble output contacts 64 and 66 while switch arm 76 is associated with a AC power indicator light or LED 136. In the normal state of the control circuit 26 when AC power is energizing the circuit, the switch arm 68 is in the "down" position as shown in FIG. 5. This partially completes and opens the circuit to the normally closed trouble output contacts 64 and the normally open trouble contacts 66, respectively, such that no signal is provided to either trouble output contact. Upon a loss of AC power, the switch arm 68 moves to the "up" position thereby open circuiting the normally closed trouble output contacts 64 to provide a signal to the external device coupled thereto to indicate a loss of AC power. At the same time, the normally open trouble output contacts 66 are closed to provide a signal thereto indicating loss of AC power. The switch arm 76, in the normal state upon powerup as shown in FIG. 5, completes the circuit to light up the AC indicator light 136. The indicator light 136 is thus on when AC power is present. In the preferred embodiment, the indicator light 136 is green, but can be any color. Thus when AC power fails, the switch arm 76 moves to the "up" position thereby open circuiting the indicator light 136 which makes the indicator light 136 inoperative.

Relay $R_{L2}$ of the supervision circuit monitors the battery power to indicate a failure of the same. The relay $R_{L2}$ has a first associated switch 72 and a second associated switch 80. The switch 72 is also associated with the trouble output contacts 64 and 66 while the switch 80 is associated with the trouble indicator light or LED 137. In like manner to the relay $R_{L1}$, the switch arm 72 of the relay $R_{L2}$ is in the "down" position when DC power is energizing the circuit to provide no signal to the output contacts 64, 66, but which provides a closed and open circuit to the normally open and normally closed trouble output contacts 66, 64, respectively, to indicate a DC power failure. The indicator light 137 comes on by movement of the switch arm 80 to the "up" position when battery power fails. Thus, relay $R_{L1}$ and relay $R_{L2}$ together monitor power to the control circuit 26, and thus the device 20, by monitoring the 100 volt primary source power and the backup battery power.

The trouble output contacts 64 are normally closed in the energized or normal state of the control circuit 26 and thus any external warning or indication device coupled thereto needs to be a normally closed type device that when a change of state to an open circuit is encountered, the device will be triggered. Opposite to the normally closed trouble output contact 64, the normally open trouble output contact 66 are normally or in the energized state open circuited. Therefore, any external warning or indication device connected to the normally open trouble output contact 66 must be adapted to receive a closed electrical signal to actuate the same. If a powered trouble output device is coupled thereto, the device may be coupled to the 12 VDC output 84.

A trouble or power failure signal is thus supplied to both the normally closed output contact 64 and the normally open output contacts 66 by a change of opposite state. This is accomplished in that, as depicted in FIG. 5, in the normal or energized state, the switch arm 68 and 76 associated with relay $R_{L1}$ complete the relay $R_{L1}$ portion of the circuit through post 69 and 77, respectively. The switch arm 76 is connected to 12.6 VDC and the post 77 is connected to the AC power indicator 136 which illuminates the indicator. Likewise, with relay $R_{L2}$, the associated switch arm 72 and 80 complete the circuit through posts 73 and 81. Upon a 120 volt power failure, the relay $R_{L1}$ becomes de-energized such that the associated switch arm 68 and 76 move to an up position to respectively connect to posts 67 and 75. Upon an AC power or battery power failure, the relay $R_{L2}$ is de-energized such that the respective switch arms 72 and 80 likewise move to an up position to contact respective posts 71 and 79. In this de-energized state, the switch arm 68 of $R_1$ or the switch arm of 72 of $R_{L2}$ are in the up position respectively contacting posts 67 or 71 creating an open circuit as seen by the trouble output contact 64 and complete the circuit as seen by the trouble contact 66. This is a change in state which would trigger the external device. At the same time, the switch arm 76 of $R_{L1}$ moves to the up position to contact post 75 creating an open circuit and extinguishing the AC power indicator 136, and illuminating the trouble indicator 137. The switch arm 80 of relay $R_{L2}$ which is connected to 12.6 VDC moves to the up position to contact the post 79 to complete the circuit and illuminate the battery power trouble indicator 137. Thus, a 120 VAC power failure or a DC battery power failure will provide a change state of signal to an external warning or indication device and extinguish the AC power indicator 136 and illuminate the trouble indicator 137 thereby letting the user know of such a power failure condition.

As indicated above, an actuating signal received by the normally open input 54 not only starts the motor via relay $R_{L3}$ but additionally provides an indication or actuating signal to the output terminals 58. The three output terminals 58 labeled C, NC, and NO (standing for common, normally closed, and normally opened) are actuated through the relay $R_{L3}$ switch arm 60. In the normal de-energized state, as depicted in FIG. 5, the switch arm 60 is positioned against post 59 such that the normally closed contact of the output contacts 58 is closed, while the normally open contact of the output 58 is open circuited. The actuating signal causes the relay $R_{L3}$ to change state thus the switch arm 60 moves to post 61 thereby changing the state of the contacts to provide the actuating signal.

Further, the control circuit 26 includes a current limited 12 volt DC output 84 for powering an external device if necessary. Also, the control circuit 26 includes a test button 86 to energize relay $R_{L3}$ to test the motor.

Figure 3:
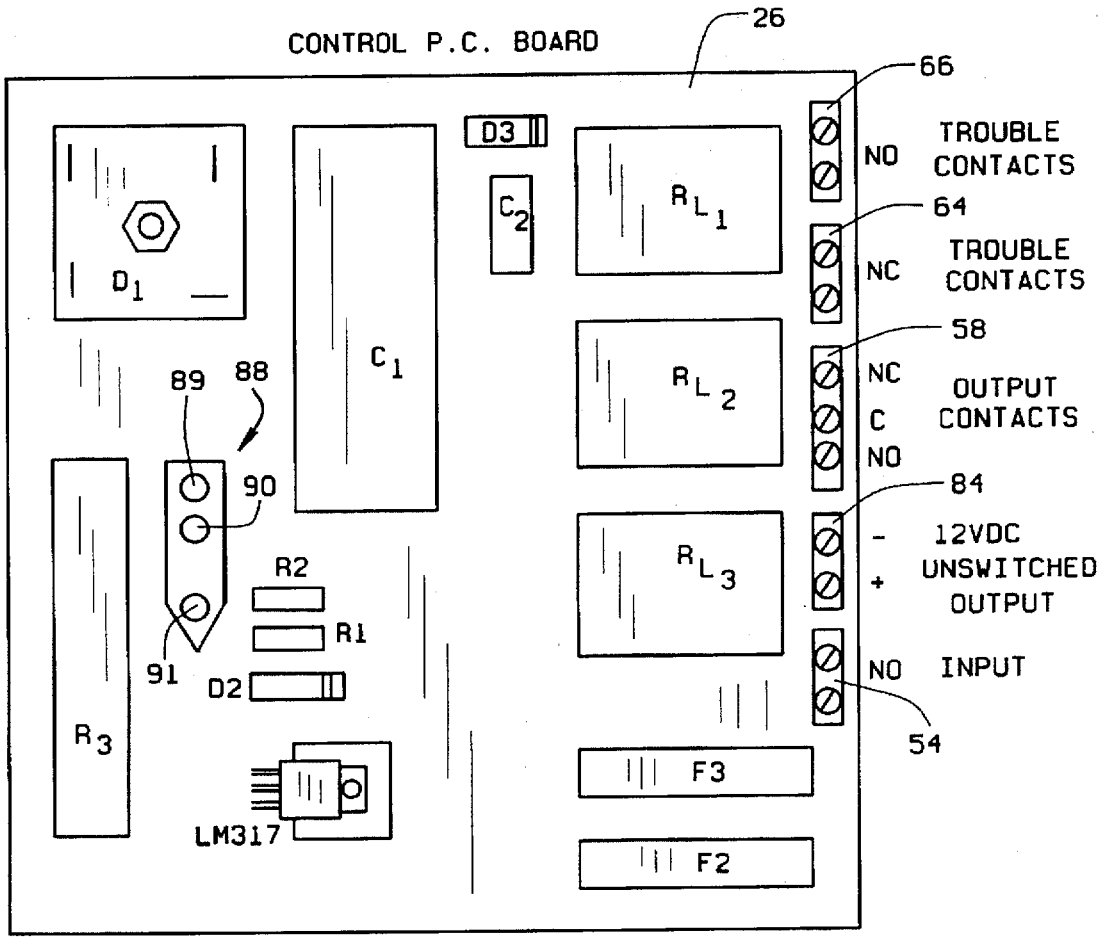
FIG. 3 is a layout of the control circuit PC board.

As a further additional feature, the control circuit 26 includes a connector or coupling 88 that provides three connection terminals 89, 90, and 91. Terminal 89 provides a ground contact, terminal 90 provides a motor energizing contact, while contact 91 provides a +12 volt DC contact. As explained below, the connector 88 is used to couple an auxiliary module 100. However, the following is a list of items utilized for the present control circuit 26. Reference should be made to FIG. 3 for the preferred control PC board layout.

| Quantity | Item | Quantity | Item |
|---|---|---|---|
| 1 | P.C. Perforated Board 4½"× 4½" | 1 | Diode 3 amp 600 PIV |
| 1 | Bridge Rectifier 10 amp | 1 | Four Pin Female Socket |
| 1 | 4700 μfd @ 35 VDC Capacitor | 4 | 4–40 × ½" Standoff |
| 1 | Silicon Diode 1 amp | 7 | #4 Lockwasher |
| 1 | 100 μfd @ 50 vdc Capacitor | 7 | 4–40 Hexnuts |
| 3 | R10 27E128 Relay Socket | 3 | 4–40 × ½" Screw |
| 2 | R10-E1-Y2-V185 Relay 12 VDC | 1 | 8–32 × ½" Screw |
| 1 | R10-E1-X2-V185 Relay 12 VDC | 1 | #8 Lock Washer |
| 4 | Two Terminal Block - PC Mount | 1 | 8–32 Hexnuts |
| 1 | Three Terminal Block - PC Mount | 2 | 16 AWG Stranded Wire - 12" |
| 2 | Fuse Holder - PC Mount | 2 | 20 AWG Stranded Wire - 12" |
| 1 | Fuse AGC ½ .5 amp | 2 | Male and Female Quick Disconnect Spade Lug |
| 1 | Fuse MDL 55 amp Slo-Blo | 2 | Female Spade Lug |
| 1 | 3.3K ohm ½w Resistor | 1 | M6mentary Push Button |
| 1 | 330 ohm ½w Resistor | 1 | Two Pin Quick Disconnect Plug and Cable |
| 1 | 10 ohm 10 Watt Resistor | 1 | 18 AWG Stranded Wire - 4" Red w/¼" Spade Lug |
| 1 | LM 317 Regulator | 1 | 18 AWG Stranded Wire - 4" Black w/¼" Spade Lug |
| 1 | Heat Sink | | |

Figure 6:
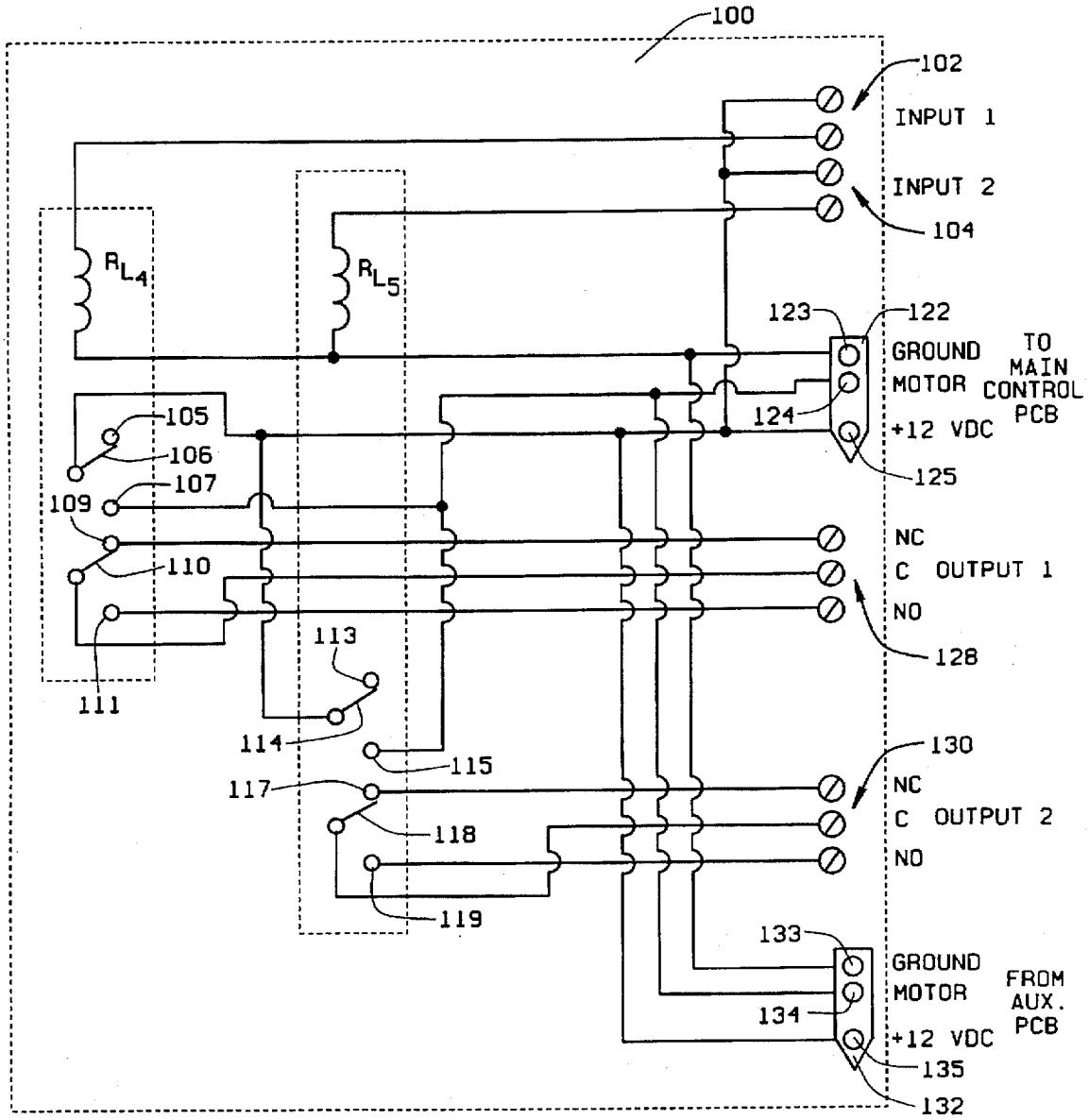
FIG. 6 is an electrical schematic of the auxiliary I/O circuit.

The control circuit 26 is adapted to receive an auxiliary unit or module 100 such that additional input devices may actuate the motor/shaker and additional external warning/indication devices coupled to the auxiliary module. With specific reference to FIG. 6, the auxiliary circuit 100 is shown. The auxiliary module circuit 100 includes a first normally open input 102 and a second normally open input 104. The input 102 actuates a relay $R_{L4}$ and associated relay switch arms 106 and 110. As input 102 is a normally open input, a closed contact external device providing an actuating signal energizes relay $R_{L4}$ such that the switch arm 106 moves from its normal up position against post 105 to the down position 107 to complete the circuit thereby providing the connection to a connector 122 that is coupled to connector 88 on the control circuit 26. The connector 122 has a ground terminal 123, a motor terminal 124, and a 12 volt DC terminal 125 that correspond to ground terminal 89, motor terminal 90, and 12 volt DC terminal 91, respectively of the connector 88 to thereby turn on the motor to provide the shaking action. Additionally, relay $R_{L4}$ closes switch arm 110 from the up position against post 109 to the down position against post 111 to provide the change of state signal for output 128. In like manner to the output contacts 58, the output contacts 128 include a normally closed terminal, NC, a common terminal, C, and a normally open terminal, NO. This is for coupling an external indication device that can receive either a normally closed or normally open activating signal. The output contacts 128 can be coupled with the 12 VDC output 84 on the control circuit 26 if the external indication device requires a powered initiating source.

Additionally, the normally open input 104 upon receipt of an actuating signal from a further closed contact input device energizes relay $R_{L5}$ that through switch arm 114 changing state from post 113 from 115 causes the motor through the connector 120 to an associated terminals 123, 124, and 125, to activate the same. In addition, the switch arm 118 moves from post 117 to 119 thereby providing a change of state signal to output 130. In like manner to output 128, output 130 includes a normally closed contact, a common contact, and a normally open contact for coupling a device of either persuasion or powered if required. Furthermore, the auxiliary module 100 includes a connector 132 having a ground terminal 133, a motor terminal 134, and a 12 volt DC terminal 135 for coupling yet further optional auxiliary module. The further optional auxiliary module would be the same as the present auxiliary module 100 in form function and operation such that a plurality of auxiliary modules may be "daisy-chained" together.

It should be understood that while the auxiliary module 100 does actuate the motor, and thus the shaking motion, it only actuates the external warning/indication devices coupled to its outputs. However, it would be possible to couple a single input device for an actuating signal to both the main control circuit 26 and the auxiliary control 100 to thereby activate several external warning/indication devices.

Figure 4:
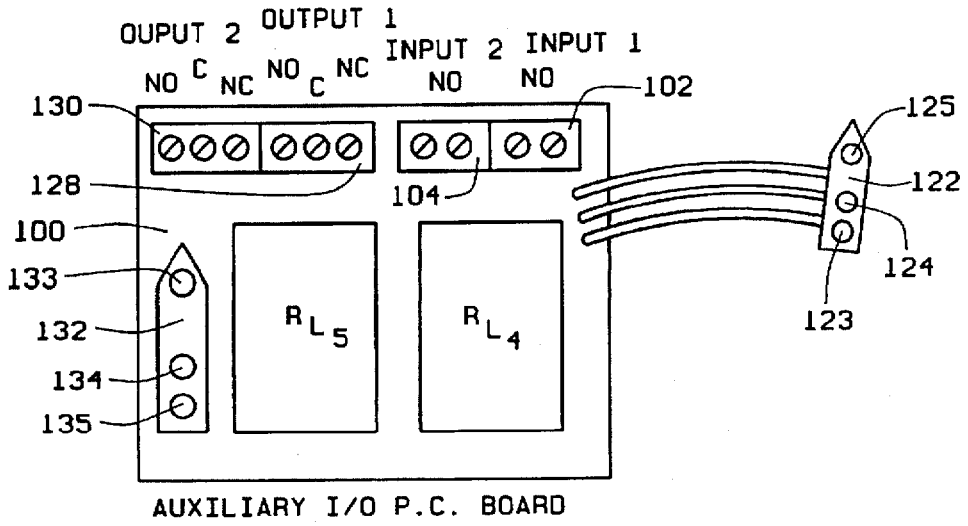
FIG. 4 is a layout of the auxiliary I/O circuit PC board.

Referring to FIG. 4, the auxiliary PC board layout is shown. Furthermore, the following is a list of parts for the auxiliary circuit 100.

| Quantity | Item | Quantity | Item |
|---|---|---|---|
| 1 | P.C. Perforated Board | 6 | #4 Lock Washer |
| 2 | R10 27E128 Relay Socket | 6 | 4–40 Hexnut |
| 2 | R10-E1-X2-V185 Relay 12 VDC | 1 | 4 Pin Female Socket |
| 2 | Two Terminal Block - PC Mount | 1 | 4 Pin Male Socket |
| 2 | Three Terminal | 1 | 18 AWG Stranded Wire - 12" Red |
| | | 1 | 18" AWG Stranded Wire - 12" Yellow |

-continued

| Quantity | Item | Quantity | Item |
|---|---|---|---|
| | Block - PC Mount | 1 | 18 AWG Stranded Wire - 12" Black |
| 2 | 4-40 × ½" Screws | | |
| 4 | 4-40 × ½" Stand Off | | |

Figure 7:
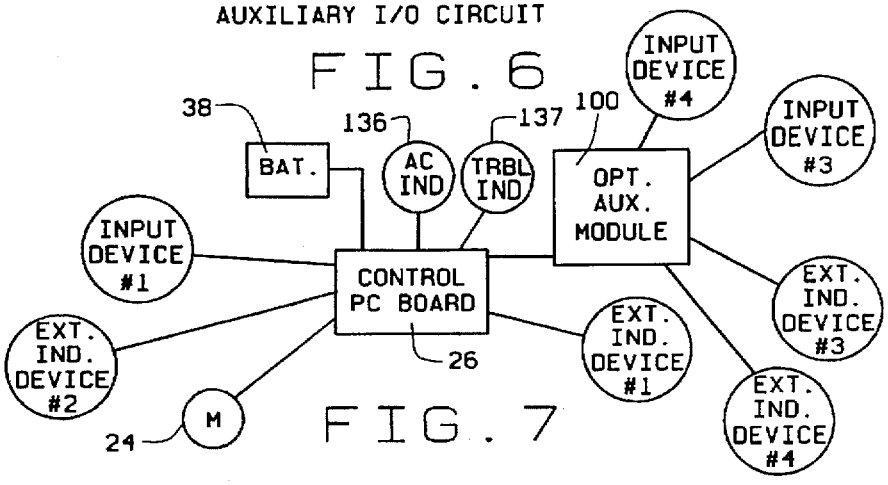
FIG. 7 is a diagram of a possible warning system layout utilizing the present warning device.

In FIG. 7, there is shown a sample hook-up for the present invention. However, it should be understood that FIG. 7 is for explanatory purposes only and is not the only hook-up.

In operation, when the device 20 is functioning, an actuating signal from an external device such as a smoke alarm, burglar alarm, etc., causes the control circuit 26 or the auxiliary module 100 to change state to turn on the motor and send a signal to any external indication devices coupled thereto. Additionally, a dual power failure of the battery or the 120 volt main power supply likewise causes a change of state that will cause a signal to be sent to any external trouble indicating devices.

While the foregoing is directed to the preferred embodiment of the present invention, other and further embodiments of the invention may be devised without departing from the basic scope thereof, and the scope thereof is determined by the claims which follow.

What is claimed is:

1. A warning unit comprising:

a housing;

a DC motor in said housing and including a rotatable shaft with a disc mounted thereon and rotatable therewith, said shaft and said disc defining an axis of rotation;

a rigid arm coupled to said disc transverse to said axis of rotation so as to reciprocate when said disc rotates, said arm adapted to be coupled to a piece of furniture so as to shake the piece of furniture upon reciprocating movement of said arm;

an AC to DC conversion circuit within said housing and electrically connected to an external AC power source, said AC to DC conversion circuit having a DC output;

a control circuit within said housing and electrically coupled to said DC output of said AC to DC conversion circuit for receipt of DC power therefrom, said control circuit coupled to said DC motor and including an activation input for receiving an activating signal from an external activating device, said control circuit turning on said motor which rotates said shaft and said disc when the external activating device provides said activating signal;

a rechargeable battery electrically coupled to said control circuit to provide backup power thereto upon an external AC power source failure;

an autoswitching circuit within said housing and electrically coupled to said control circuit, said autoswitching circuit allowing energy from said battery to power said circuits upon a loss of the external AC power source, and allowing energy from the external AC power source to power said circuits and cutting off said battery power upon restoration of the external AC power source; and a supervision circuit within said housing and electrically coupled to said control circuit, said supervision circuit monitoring the external AC power source and said battery for inoperativeness and providing an alarm indication signal upon finding any such inoperativeness.

2. The warning unit of claim 1, further comprising:

a battery charging circuit within said housing and electrically coupled to said control circuit and said battery, said battery charging circuit charging said battery from the external AC power source when said control circuit is receiving energy from the external AC power source; and a test switch for circuit operation verification.

3. The warning unit of claim 1, wherein said control circuit includes an isolated DC output to power a second external activating device, and a second activation input for receiving a second activation signal from said second external activating device.

4. The warning unit of claim 1, wherein said control circuit further includes an output terminal for sending a signal to an external indication device upon said control circuit's receipt of said activating signal.

5. The warning unit of claim 1, wherein said control circuit includes an auxiliary module input for coupling an auxiliary control module thereto, said auxiliary control module including an isolated output contact and an isolated input contact, said isolated input contact adapted to receive an activation signal from an external activation device, said isolated output contact connectable to said activation input of said control circuit.

6. A device for shaking a piece of furniture upon receipt of an alarm indication signal, the device comprising:

a housing;

a DC motor disposed within said housing and having a rotatable shaft extending external to said housing, said shaft defining an axis of rotation;

a hub connected to an end of said shaft external to said housing and rotatable with said shaft;

an arm connected to said hub so as to reciprocate transverse to said axis of rotation, said arm coupled to the piece of furniture;

a control circuit coupled to a 120 volt AC source and said motor, said control circuit including a full-wave rectifier and a normally open input and operable to start said motor upon receipt of the alarm indication signal at said input;

a backup battery coupled to said control circuit;

an autoswitching circuit coupled to said battery and said control circuit that allows energy from said battery to power said control circuit upon a failure of the 120 volt AC source, and that stops and cuts off energy from said battery upon a restoration of the 120 volt AC source;

a charging circuit coupled to said control circuit that charges said battery when energy is supplied to said control circuit from the 120 volt AC source; and a supervision circuit coupled to said control circuit that monitors said battery and the 120 volt AC source and provides a power out signal to a trouble contact when no power is being supplied to said control circuit.

7. The device of claim 6, further comprising auxiliary input coupling for operably connecting an auxiliary input and indication module thereto.

8. The device of claim 6, further comprising:

a +12 VDC output;

a test circuit; and a dual open/closed contact output.

9. The device of claim 6 wherein said trouble contact of said supervision circuit is normally open, and said supervision circuit further includes a normally closed trouble contact.

10. The device of claim 6, wherein said supervision circuit further includes indicators that identify a normal and abnormal state of the system.

* * * * *